US005624081A

United States Patent [19]

Turk et al.

[11] Patent Number: 5,624,081

[45] Date of Patent: Apr. 29, 1997

[54] YARN WINDING APPARATUS

[75] Inventors: Herbert Turk, Remscheid; Herbert Schiminski, Huckeswagen, both of Germany

[73] Assignee: Barmag AG, Remscheid, Germany

[21] Appl. No.: 491,880

[22] PCT Filed: Dec. 14, 1993

[86] PCT No.: PCT/EP93/03527

§ 371 Date: Aug. 1, 1995

§ 102(e) Date: Aug. 1, 1995

[87] PCT Pub. No.: WO94/14694

PCT Pub. Date: Jul. 7, 1994

[30] Foreign Application Priority Data

Dec. 23, 1992 [DE] Germany ..... 42 43 671.0
Mar. 20, 1993 [DE] Germany ..... 43 08 989.5

[51] Int. Cl.[6] ..... B65H 54/28

[52] U.S. Cl. ..... 242/43 A

[58] Field of Search ..... 242/43 R, 43 A

[56] References Cited

U.S. PATENT DOCUMENTS

| | | | |
|---|---|---|---|
| 3,650,486 | 3/1972 | Hasegawa et al. | 242/43 A |
| 4,505,436 | 3/1985 | Schippers et al. | 242/43 A |
| 4,561,603 | 12/1985 | Schippers et al. | 242/43 A |
| 4,798,347 | 1/1989 | Schippers et al. | 242/18 R |
| 4,991,783 | 2/1991 | Sugioka | 242/43 A |
| 5,176,330 | 1/1993 | Tone | 242/43 A |

FOREIGN PATENT DOCUMENTS

| | | |
|---|---|---|
| 120439 | 10/1989 | China . |
| 122559 | 11/1989 | China . |
| 0144642 | 8/1984 | European Pat. Off. . |
| 0120216 | 10/1984 | European Pat. Off. . |
| 0166292 | 9/1987 | European Pat. Off. . |
| 3404303 | 2/1984 | Germany . |
| 3703731 | 8/1987 | Germany . |
| 3417457 | 10/1991 | Germany . |
| 4142886 | 7/1992 | Germany . |
| 4-251076 | 12/1990 | Japan . |

*Primary Examiner*—Michael R. Mansen
*Attorney, Agent, or Firm*—Bell, Seltzer, Park & Gibson, P.A.

[57] ABSTRACT

A yarn traversing apparatus which includes a pair of oppositely rotating blades for respectively moving the yarn in opposite directions along a main guide edge in a medial portion of the yarn traverse stroke. An auxiliary yarn guide is mounted in each of the ends of the traverse stroke. The main guide edge and the auxiliary guide edges extend through the traverse plane from opposite sides thereof, and they are configured so that the main guide edge guides the yarn and controls its speed along the medial portion of the stroke and the auxiliary yarn guides guide the yarn and controls its speed in the end regions of the stroke. The yarn tension thereby can be maintained substantially constant along the full length of the stroke.

6 Claims, 4 Drawing Sheets

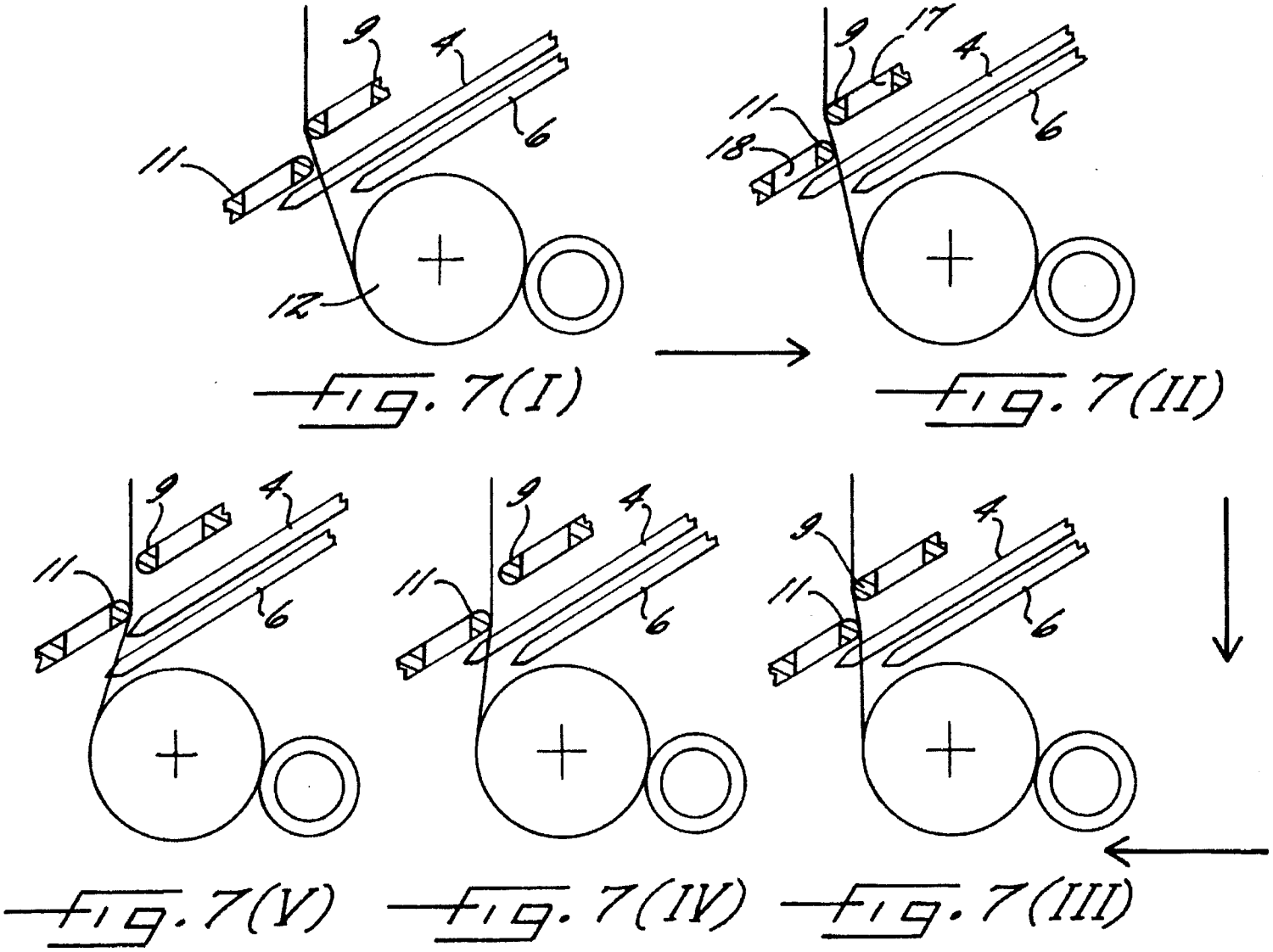
FIG. 7(I)
FIG. 7(II)
FIG. 7(III)
FIG. 7(IV)
FIG. 7(V)

YARN WINDING APPARATUS

BACKGROUND OF THE INVENTION

The invention relates to a yarn winding apparatus having a yarn traversing system which includes a guide edge and a pair of oppositely rotating blades for respectively moving the yarn in opposite directions along the guide edge. Such a yarn winding apparatus is known, for example, from DE 34 04 303 A1; EP 120 216 A; DE 34 17 457 C2; DE 37 03 731 A1.

In the yarn traversing systems of these yarn winding apparatus, the guide edge has the following function: the yarn entraining arms or rotary blades have a constant angular speed, but have between the stroke ends a different guiding speed in the traversing direction, in which the yarn is to be reciprocated parallel to the package axis. The guiding speed is dependent on the constantly changing angular position of the rotary blades and, therefore, is sinusoidal. The main guide edge deflects the yarn from the traversing plane such that these speed differences are compensated in desired manner. A corresponding configuration of the guide edge allows to accomplish that the traverse speed is constant between the stroke ends—i.e., apart from the short reversal regions, in which the direction of movement is reversed. However, the configuration of the guide edge and the rotary blades also allows to predetermine desired laws of movement. In this connection, the traversing plane is described as the tangential plane which extends through the apex yarn guide and the subsequent rotating cylinder to which the yarn advances. The apex yarn guide is arranged centrically above the traverse stroke. It is spaced apart from the rotating cylinder such that the yarn is able to stand the yarn tension fluctuations which result from the traversing motion. These yarn tension fluctuations result from the fact that the yarn length between the apex yarn guide and rotating body changes continuously, i.e., increases and decreases, as a result of the traversing motion. The rotating body is generally a contact roll, to which the yarn advances, and about which the yarn loops partially, so as to then advance to the package.

Yarn traversing systems of the prior art permit to reciprocate the yarn over a long traverse stroke, for example 250 mm, with only one rotor for each direction of movement. As a result, however, it is necessary to compensate for great differences in the guiding speed. For this reason, the guide edge extends, in particular in the central region of the traverse stroke, far into the traversing plane, whereas it extends in the region of the traverse stroke ends close to the traversing plane. Accordingly, the looping angle of the yarn on the guide edge is large in the central region of the traverse stroke, and accordingly the looping angle of the yarn on the guide edge is small in the region of the stroke ends.

It is the object of the invention to avoid these great differences in the looping angle, which also lead to different yarn tensions, and to thereby enable long traverse strokes.

SUMMARY OF THE INVENTION

The above and other objects and advantages of the present invention are achieved by the provision of a yarn traversing apparatus which comprises means for reciprocating an advancing yarn transversely to its advance direction over a predetermined traverse stroke and so as to define a traverse plane, and at least two guide arms mounted for rotation about closely adjacent parallel or coaxial axes so that the rotating arms define closely adjacent parallel planes and the extremity of each rotating arm is adapted to pass along the traverse plane. The arms are rotated in opposite directions so that one arm moves in a direction toward one end of the traverse stroke and the other arm moves in the opposite direction and from the one end of the traverse stroke toward the other end thereof. Also, a yarn guide rail is mounted on one side of the traverse plane and defines a main guide edge which extends in a direction generally parallel to the traverse stroke and through the traverse plane in a medial portion of the yarn traverse stroke to thereby guide the yarn and control its traversing speed, and the main guide edge does not extend through the traversing plane adjacent either of the end regions of the traverse stroke. In addition, an auxiliary guide edge is mounted in each of the end regions of the traverse stroke and on the other side of the traverse plane, with the auxiliary guide edges each extending through the traverse plane so that in the end regions the auxiliary guide edges guide the yarn and control its transverse speed.

The invention as described above allows the maximum looping angles which naturally occur in the region of the greatest deviation of the guide edges from the traversing plane to be considerably reduced. Preferred is an arrangement, in which the maximum looping angles are approximately identical, so that the yarn tension remains within certain limits. The advantage of the invention is that an unacceptable decrease of the yarn tension can be avoided in the end regions of the traverse stroke. In the known yarn winding apparatus, it is necessary to select the yarn tension so high that its does not fall below a minimum value even in the end regions of the stroke. This means on the other hand that the yarn tension is relatively high in the central region of the traverse stroke. The invention, however, counteracts the tendency of the yarn tension to be reduced in the end regions of the stroke, and permits the tension to remain above a minimum value even when a low yarn tension is selected.

In a preferred embodiment, the plane of the rotor axes and the main guide edge are arranged with respect to the traversing plane such that the yarn defines a first looping angle as it moves across the medial portion of the main guide edge, and a second looping angle as it moves across each of the auxiliary yarn guides, with the first and second looping angles being approximately the same.

When winding a multifilament yarn, it is necessary to produce the package such as to permit the yarn to unwind again from the package also at a high speed. This becomes possible in particular, when the yarn is deposited on the package in closed form, i.e., as if it were a uniform substantially round body. The contrary thereof is that the individual filaments, of which the yarn consists, are deposited on the package in the form of a wide band. In this instance, there is the risk during the unwinding of the yarn, that the individual filaments belonging together do not separate simultaneously and evenly from the wound surface. The yarn unwinds unevenly and may lead to a yarn or filament breakage. To avoid having the yarn deposited as a wide band, the planes defined by the main guide edge and the auxiliary guide edges may be located upstream of and closely adjacent the planes defined by the rotating guide arms. By this arrangement, the yarn is deposited on the package as a closed body—and not as a wide band consisting of individual filaments. In particular, this arrangement avoids having the enlargement of the individual filaments, which has previously been caused by directing a strong air current toward the yarn, be undone and dissolved.

Prerequisite therefor—as well as in all other embodiments—is that the two guide edges are arranged very close to one another and to the rotary planes of the yarn entraining arms.

The plane of the main guide edge and the plane of the auxiliary guide edges may be disposed on opposite sides of the planes defined by the rotating arms. This permits a particularly exact transfer of the yarn from one rotary blade to the other in the reversal regions, and avoids the engineering problem of the close arrangement of the guide edges.

Basically, it is possible to arrange the main guide edge on either side of the yarn advancing plane. Preferred, however, is that the main guide edge extends between the plane of the advancing yarn and the plane of the rotor axes. This is of advantage in particular for the operation and the threadup of the yarn.

As already earlier described, it is useful to arrange at least the main guide edge—in direction of the yarn advance—upstream of the plane of the rotary blades. In this instance, the main guide edge covers the rotary blades, when it is arranged simultaneously between the plane of advance and the plane of the rotor axes, thereby complicating a proper relative adjustment of the rotors. To avoid this, a construction may be employed wherein each guide edge consists of a frame attached to the machine frame, which circumscribes a window. The portion of the frame, which extends into the traversing plane, forms the guide edge. Otherwise, the window is cut out so wide as to make visible primarily the end regions of the traverse stroke, in which the yarn is transferred from the one rotary blade to the other.

BRIEF DESCRIPTION OF THE DRAWINGS

In the following, an embodiment of the invention is described with reference to the drawing.

In the drawing:

FIGS. 7(I) through 7(V) are side views of an embodiment showing several phases of the traversing motion.

DETAILED DESCRIPTION OF THE PREFERRED EMBODIMENTS

Figure 2:
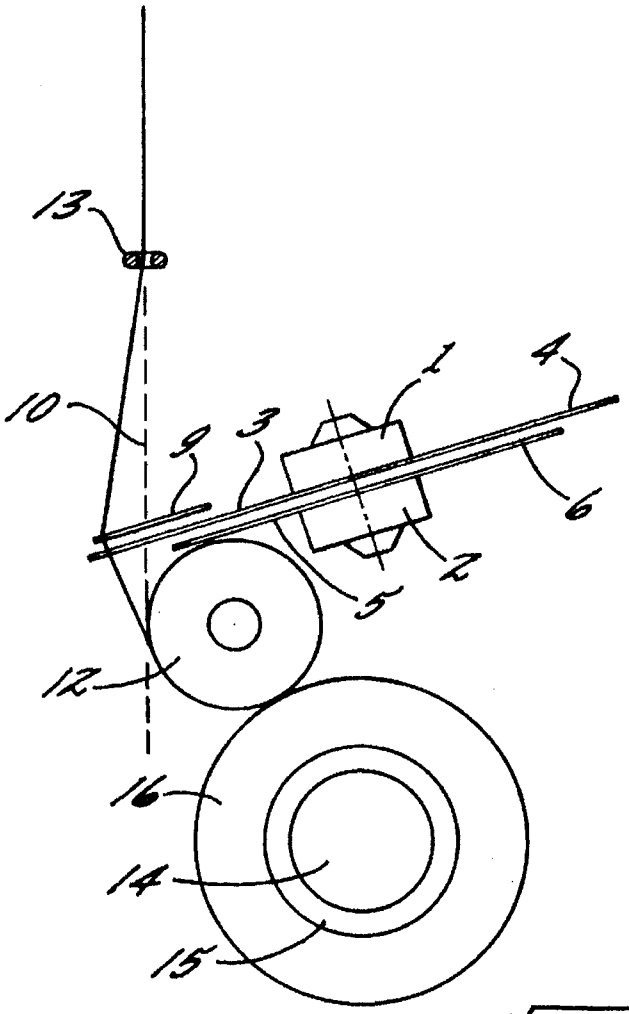
FIG. 2. (PRIOR ART)
FIGS. 1 and 2 are side views of a conventional yarn winding apparatus showing different yarn positions with respect to the traverse stroke.

Common to the embodiments of yarn winding machines illustrated in the present application is the following: a yarn advances via an apex yarn guide 13 to a yarn traversing system and thence to a contact roll 12. The yarn partially loops about contact roll 12, for example at 60°, and then advances onto a package 16. The contact roll is in circumferential contact with package 16. The package 16 is formed on a paper or plastic tube 15. The plastic tube 15 is placed on a spindle 14. The spindle 14 is driven at a speed, which decreases in the course of the winding cycle. The control of the spindle drive occurs as a function of the speed of contact roll 12, which is measured for this purpose. The control of the spindle or spindle drive occurs such that the speed of contact roll 12 remains constant. The yarn traversing system consists of rotors 1 and 2, to which several yarn entraining arms—also named rotary blades within the scope of the present application—are attached. The rotor 1 has, for example, two yarn entraining arms 3 and 4, each offset relative to the other by 180°. The rotor 2 has yarn entraining arms 5 and 6, likewise offset relative to one another by 180°. The rotors are arranged such that the yarn entraining arms 5 and 6 on the one hand, and 3 and 4 on the other rotate in two closely adjacent planes of rotation parallel to one another. At the same time, however, the rotor axes, as shown in FIG. 5, are arranged eccentrically along a line which is parallel to the axis of the yarn package.

The rotors are driven in opposite direction of rotation and at 90° out-of-phase. If each of the rotors has, for example, three yarn entraining arms, same will be offset relative to one another by 120°. The rotary blades 3–6 guide the yarn along a guide edge 9 (main guide edge). Along each path, the yarn is guided by a rotary blade of the one rotor. At the stroke ends, this rotary blade moves below the guide edge, and the guidance of the yarn in the opposite direction is then taken over by one of the rotary blades of the other rotor, which emerges at this moment from below the guide edge. Such a yarn traversing system is described, for example, in EP-C 114,642.

Figure 5:
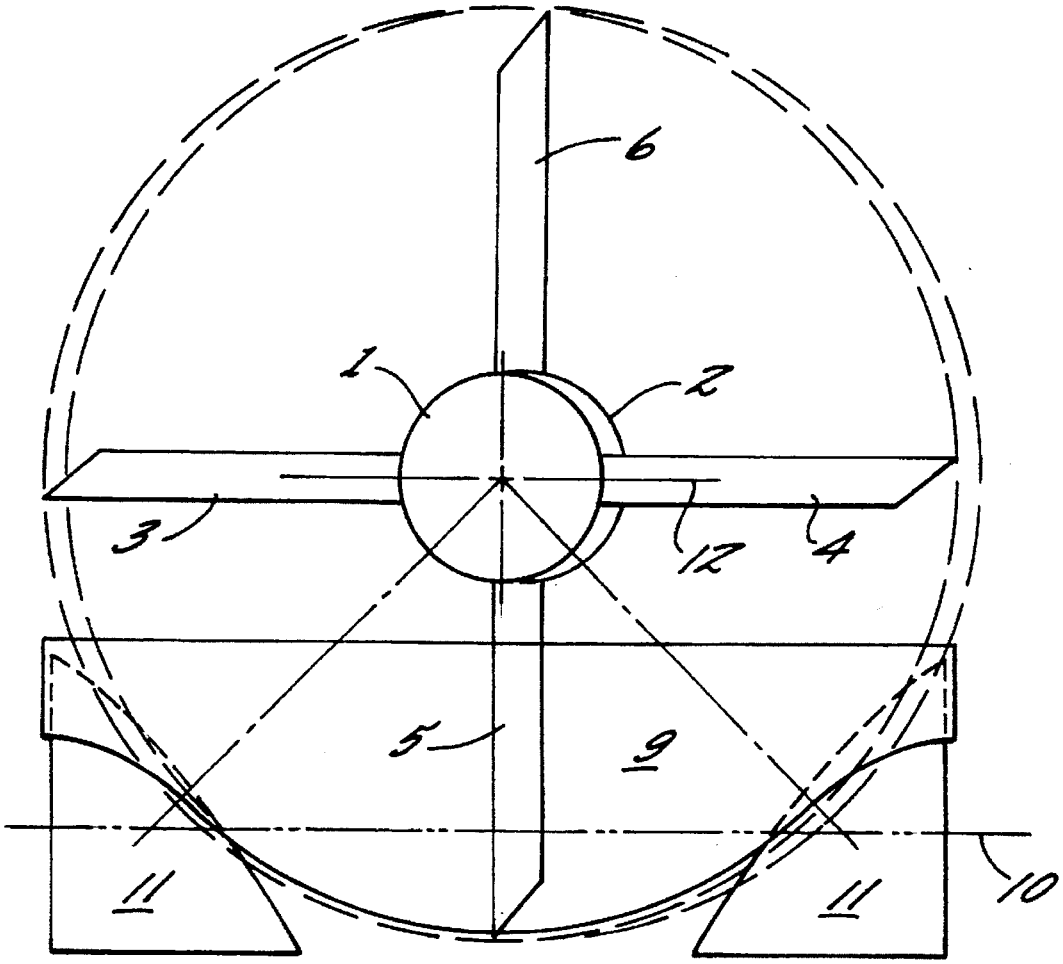
FIG. 5 is a top view (schematic) of a yarn traversing system with a main guide edge and auxiliary guide edges.

Each of rotors 1 and 2 of FIG. 5 comprises two yarn entraining arms 3 and 4 or 5 and 6 offset relative to one another by 180°. Yarn entraining arm 5 of rotor 2 is currently in control of guiding the yarn, and guides the yarn to the left. At the end of the traverse stroke, it delivers the yarn to the oncoming arm 3 of oppositely rotating rotor 1. Main guide edge 9 extends with a certain profiling into the traversing plane, which is here indicated as line 10. This means: the yarn advances from the direction of the viewer, and the traversing plane extends perpendicularly to the plane of the paper. Arranged in the region of the traverse stroke ends are auxiliary guide edges 11 extending in two planes, which are closely adjacent to both the planes of rotation of the yarn entraining arms and relative to one another. The main guide edge extends into the traversing plane from the same side as the yarn entraining arms. The auxiliary guide edges 11 extend into traversing plane 10 from the opposite direction.

Figure 1:
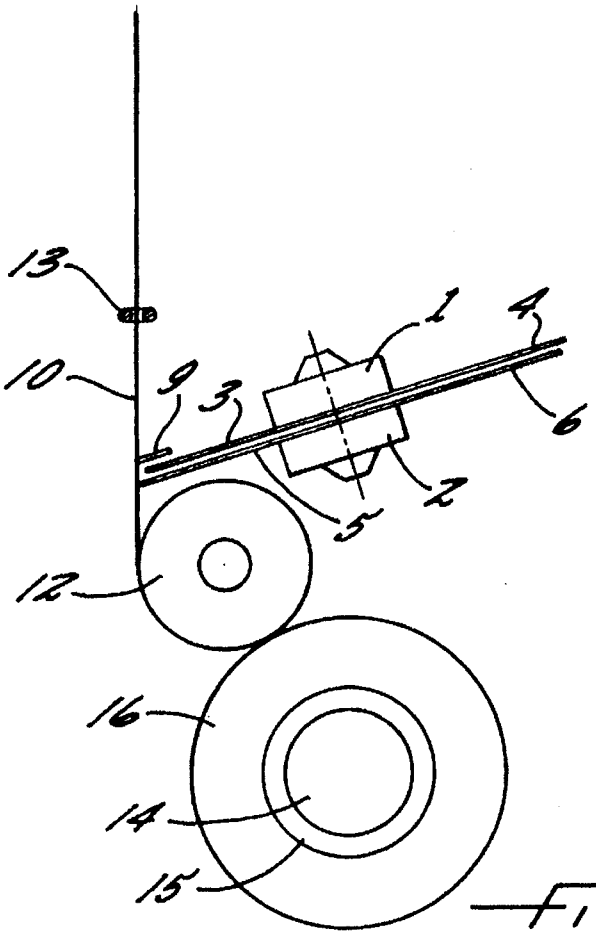
FIG. 1. (PRIOR ART)

The yarn winding apparatus of the prior art (FIG. 1) now shows that main guide edge 9 in FIGS. 1 and 2 deflects the yarn from traversing plane 10 shown in dashed lines, both at the end of the traverse stroke (illustration of FIG. 1) and in the center of the traverse stroke (illustration of FIG. 2).

As shown in FIG. 2, this results in a very considerable looping of the yarn on the main guide edge in the central region of the traverse stroke. In the end regions, as shown in FIG. 1, only a very slight looping is left. This change in the looping entails also a corresponding change of the yarn tension, under which the yarn advances to contact roll 12 or package 16. In the end regions, as shown in FIG. 1, the yarn is no longer or only slightly deflected from traversing plane 10. This deflection, as shown in FIG. 2, is very great in the central region of the traverse stroke. This deflection causes a high yarn tension, since the yarn is advanced from a feed system at a fixed speed, and therefore any deflection is converted into a corresponding elongation and increase of the yarn tension. On the other hand, the yarn tension in the end regions should be sufficient to permit a troublefree winding operation. Consequently, the yarn tension is all the higher in the central region, and it cannot always be avoided that the yarn tension in the central region exceeds the limit of impairment.

Figure 4:
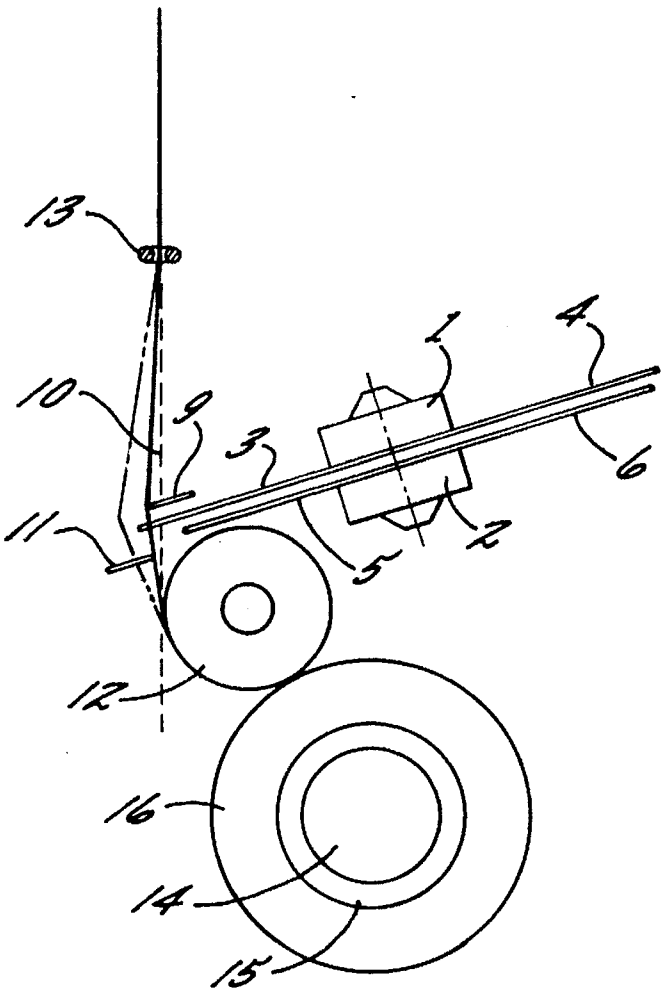
FIGS. 3 and 4 are side views of an embodiment of the invention showing different yarn positions along the traverse stroke.
Figure 3:
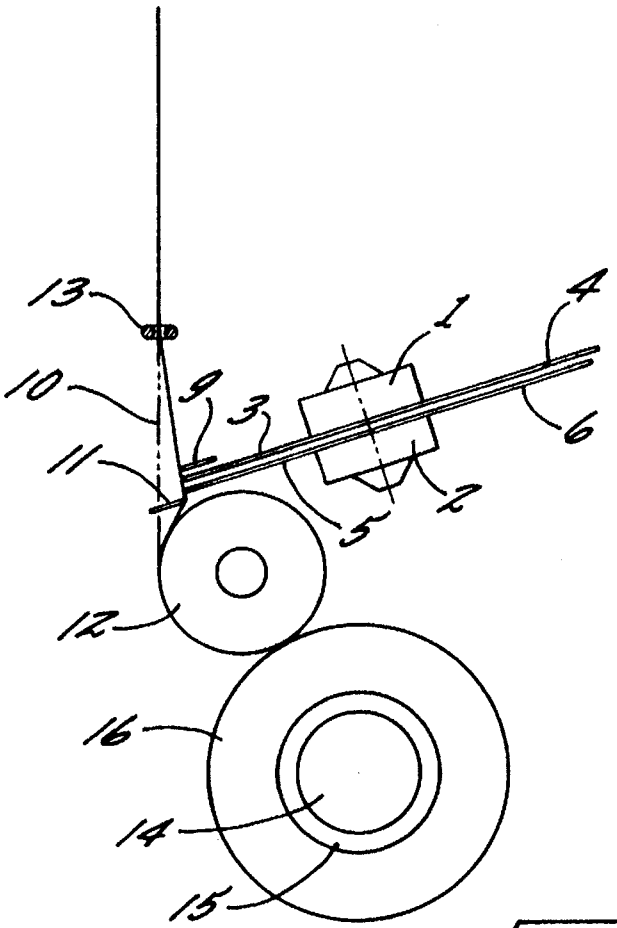

In contrast to this, remedial measures are taken in the embodiments of FIGS. 3 and 4, as well as 6 and 7(I) through 7(V).

As seen in FIGS. 3 and 4 showing the first embodiment of the present invention, the main guide edge 9 is removed from the traversing plane likewise shown in dashed lines so far that at the traverse stroke ends (FIG. 3), main guide edge 9 does no longer extend into the traversing plane. Rather, at this point, auxiliary guide edges 11 extend from the opposite side into the traversing plane, and at the traverse stroke ends they take over the guidance of the yarn. The auxiliary guide edges 11 also provide for compensation of the guiding speed of the yarn entraining arms in the sense of a desired course of the traversing speed, as well as the compensation for the looping angle, which is lost on the main guide edge. They also provide compensation for the deflection of the yarn from traversing plane 10. As is shown in FIGS. 3–5, main guide edge 9 and auxiliary guide edge 11 overlap in the end regions of the stroke. As shown in FIG. 5, the auxiliary guide edges take over the guidance approximately or preferably, when viewed from the center of the traverse stroke, somewhat before the intersection of traversing plane 10 with main guide edge 9. This allows to accomplish that the looping angles are approximately identical on the main and auxiliary guide edges.

Figure 6:
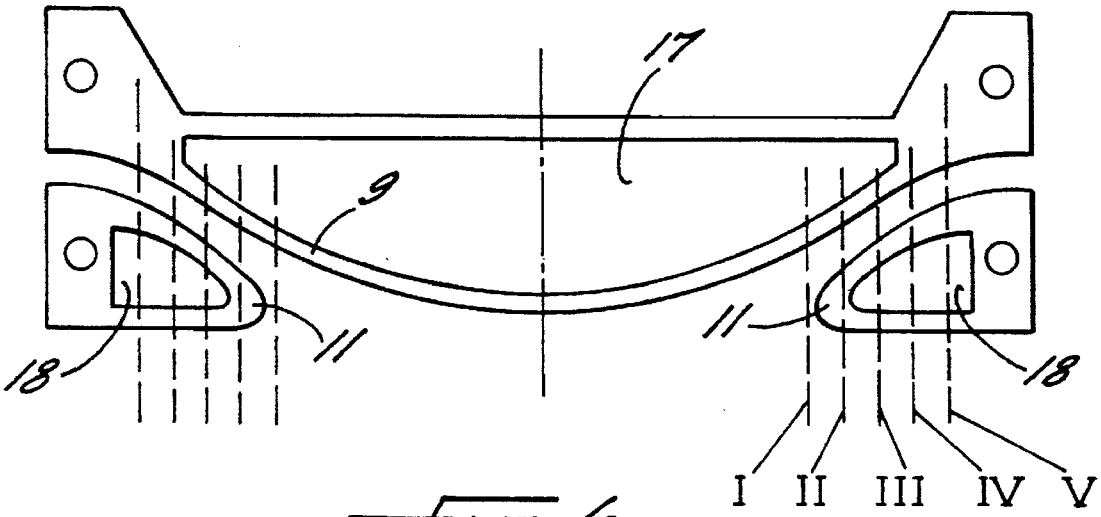
FIG. 6 is a top view of further embodiments.

As shown in FIGS. 6 and 7(I) through 7(V), it is not absolutely necessary to arrange main guide edge 9 and auxiliary yarn guides 11 such that an overlapping occurs (viewed in the yarn direction). Rather, the relative arrangement of the guide edges is dependent on the entire geometrical arrangement of the yarn path, traversing system, contact roll, and package.

In FIG. 6, the individual phases are indicated by dashed lines I–V. FIGS. 7(I) through 7(V) the same yarn winding apparatus in different phases I–V of the traversing motion one following the other in direction of the arrows. Shown in FIG. 7(I) is the situation in the center of the traverse stroke. Rotary blade 4 guides the yarn while it is deflected by main guide edge 9. In phase II, the yarn has already entered into the guide slot between main guide edge 9 and auxiliary guide edge 11 in the end region of the traverse stroke. In this phase, auxiliary guide edge 11 contacts the yarn for the first time. In phase III, as can be noted, the yarn is deflected by both the main guide edge and the auxiliary guide edge. As a result, the looping angle remains substantially constant.

In phase IV, the main guide edge is completely retracted from the traversing plane. The yarn is now exclusively guided by the auxiliary guide edge. Phase V shows the end of the traverse stroke. The yarn is transferred from the one rotary blade 4 of the one rotor to the other rotary blade 6 of the other rotor. Likewise in this phase V, the auxiliary guide edge is exclusively in control of guiding the yarn in direction of the traverse.

A further characteristic of the embodiment of FIGS. 6 and 7(I) through 7(V) is that main guide edge 9 and auxiliary guide edges 11 are arranged in closely adjacent, parallel planes preceding the planes of the rotary blades. This arrangement allows to accomplish that the yarn does not disintegrate into its individual filaments when being raised from contact roll 12 or the package. Rather, the yarn is deposited as a closed filament bundle on the package and, consequently, also again withdrawn as a closed filament bundle when being unwound from the package. The described rotary blade type traversing system makes it necessary to accurately adjust the rotary blades on the rotors, so that the yarn is transferred from the one rotary blade to the other at a certain point. To this end, one must be able to observe the rotary blades. For this purpose, a window 17 in the main guide edge and windows 18 in the auxiliary guide edges are used. The guide edges are therefore constructed as frames which each leave space for a window.

We claim:

1. A yarn traversing apparatus comprising means for reciprocating an advancing yarn transversely to its advance direction over a predetermined traverse stroke and so as to define a traverse plane, at least two guide arms mounted for rotation about closely adjacent parallel or coaxial axes so that the rotating arms define closely adjacent parallel planes and the extremity of each rotating arm is adapted to pass along the traverse plane, means for rotating each of the arms in opposite directions so that one arm moves in a direction toward one end of the traverse stroke and the other arm moves in the opposite direction and from the one end of the traverse stroke toward the other end thereof, a yarn guide rail mounted on one side of the traverse plane and defining a main guide edge which extends in a direction generally parallel to the traverse stroke and through the traverse plane in a medial portion of the yarn traverse stroke to thereby guide the yarn and control its traversing speed, and wherein the main guide edge does not extend through the traversing plane adjacent either of the end regions of the traverse stroke, and an auxiliary guide edge in each of the end regions of the traverse stroke and mounted on the other side of the traverse plane, with the auxiliary guide edges each extending through the traverse plane so that in the end regions the auxiliary guide edges guide the yarn and control its transverse speed.

2. The yarn traversing apparatus as defined in claim 1 wherein the yarn defines a first looping angle as it moves across the medial portion of the main guide edge, and a second looping angle as it moves across each of the auxiliary guide edges, and wherein the first and second looping angles are approximately the same.

3. The yarn traversing apparatus as defined in claim 1 wherein the main guide edge defines a first plane which is parallel to the planes of the rotating guide arms, and the auxiliary guide edges define a second plane which is parallel to the planes defined by the rotating guide arms, and wherein the first and second planes are upstream of the planes defined by the rotating guide arms and closely adjacent to each other.

4. The yarn traversing apparatus as defined in claim 1 wherein the main guide edge defines a first plane which is parallel to and on one side of the planes defined by the rotating guide arms, and wherein the auxiliary guide edges define a second plane which is parallel to and on the opposite side of the planes defined by the rotating guide arms.

5. The yarn traversing apparatus as defined in claim 1 wherein the means for rotating the two guide arms define at least one rotational axis which is disposed on one side of said traverse plane, and wherein said yarn guide rail is mounted on said one side of said traversing plane.

6. The yarn traversing apparatus as defined in claim 1 wherein said yarn guide rail is in the form of an open framework which defines a window for facilitating the viewing of the rotating guide arms.

* * * * *